US007126485B2

(12) United States Patent
Cece et al.

(10) Patent No.: US 7,126,485 B2
(45) Date of Patent: Oct. 24, 2006

(54) SLEEP PREVENTION DEVICE WHILE DRIVING

(76) Inventors: Anthony M. Cece, 24 Fairway Ave., West Long Branch, NJ (US) 07764; Rose M. Cece, 24 Fairway Ave., West Long Branch, NJ (US) 07764

( * ) Notice: Subject to any disclaimer, the term of this patent is extended or adjusted under 35 U.S.C. 154(b) by 212 days.

(21) Appl. No.: 10/840,140

(22) Filed: May 6, 2004

(65) Prior Publication Data

US 2005/0248462 A1 Nov. 10, 2005

(51) Int. Cl.
*H60Q 1/00* (2006.01)

(52) U.S. Cl. ..... 340/576; 340/439; 340/573.1; 340/686.1; 340/686.2; 340/575; 340/438

(58) Field of Classification Search ..... 340/438, 340/439, 573.1, 686.1, 686.2, 575, 576
See application file for complete search history.

(56) References Cited

U.S. PATENT DOCUMENTS 5,682,144 A * 10/1997 Mannik ..... 340/575
5,907,282 A * 5/1999 Tuorto et al. ..... 340/576
6,147,612 A * 11/2000 Ruan et al. ..... 340/575
6,559,770 B1 * 5/2003 Zoerb ..... 340/575

* cited by examiner

*Primary Examiner*—Julie Bichngoc Lieu
(74) *Attorney, Agent, or Firm*—Ezra Sutton, Esq.

(57) ABSTRACT

A sleep prevention device while driving a vehicle including a housing member having an interior compartment; and the interior compartment includes a movable cord member with a distal end and a proximal end having a first contact member on the cord member. The interior compartment also includes two spaced-apart second contact members for engagement by the first contact member. The sleep prevention device further includes an earpiece assembly having an earpiece housing member with an alarm member therein connected to a speaker member in the earpiece housing. The distal end of the movable cord member is connected to the earpiece assembly. The first contact member moves in either a forward direction or a rearward direction as the driver's head moves as the driver starts to doze or fall asleep such that the first contact member moves and engages one of the second contact members in order to activate the alarm member and produce an alarm sound in the driver's ear from the speaker member of the alarm member for awakening the driver from his/her dozing or sleeping state.

41 Claims, 12 Drawing Sheets

SLEEP PREVENTION DEVICE WHILE DRIVING

FIELD OF THE INVENTION

The present invention relates to a sleep prevention device while driving. More particularly, it relates to a sleep prevention device that is attached to a driver's headrest and to the driver's ear in order to detect movement of the driver's head more than a predetermined distance in a forward or rearward direction which activates a sound alarm if the driver dozes or falls asleep at the wheel of a vehicle while driving.

BACKGROUND OF THE INVENTION

The National Highway Traffic Safety Administration of the Untied States estimates that on average each year approximately 100,000 vehicular accidents are caused by sleepy (dozing or falling asleep at the wheel) drivers. Drowsy driving kills yearly about 1,500 (drivers and passengers) and causes 71,000 bodily injuries. For example, if a drowsy driver is driving at 65 mph and nods off for just three (3) seconds, the driver will have traveled the length of a football field, if the driver does not hit something first. A survey conducted by the National Sleep Foundation found that 17 percent of the drivers polled indicated they had fallen asleep at the wheel of their vehicle within the past year. The state of New Jersey during 2003 has enacted "Maggie's Law" which authorizes a vehicular homicide conviction if a driver is in a fatal crash after at least 24 sleepless hours. The New Jersey statute is the first such law enacted in the United States.

There remains a need for a sleep prevention device while driving that responds to a driver when dozing or falling asleep at the wheel of moving vehicle, as the driver's head moves forward or rearward, in order to sound activate a alarm in the driver's ear. Additionally, the sleep prevention device should include an ear piece element having the alarm mechanism within the ear piece to wake the driver.

DESCRIPTION OF THE PRIOR ART

Driver dozer alarms, driver sleep/fatigue alarms, sleep warning systems for vehicle operators, having various designs, structures, configurations and materials of construction have been disclosed in the prior art. For example, U.S. Pat. No. 2,842,628 to JAMES discloses a driver dozer alarm having an alarm activator assembly connected to a chin saddle and a breast plate for wearing on the chin area of a driver. This prior art patent does not teach or disclose the design, configuration and structure of the present invention.

U.S. Pat. No. 4,209,075 to MESSINA discloses an automobile safety assembly for the proper operation of a moving vehicle. This system uses a shoulder strap for the driver of a moving vehicle for automatically braking the vehicle and de-energizing the ignition circuit in order to energize a warning signal in the event the driver slumps in his/her seat because of sickness, injury, sleepiness, dozing, unconsciousness, or other incapacitating conditions rendering the driver unable to properly operating the vehicle. This prior art patent does not teach or disclose the design, configuration and structure of the present invention.

U.S. Pat. No. 6,107,922 to BRYUZGIN discloses a driver sleep/fatigue alarm which is capable of determining the fatigued or sleepy condition of the driver and subsequently triggering the alarm by detecting the lowering motion of the driver's lower jaw and tilting of the head. The alarm is mounted around the driver's head and to the area under the driver's lower jaw. This prior art patent does not teach or disclose the design, configuration and structure of the present invention.

None of these prior patents teach or disclose the structure of a sleep prevention device while driving having a detection assembly being attached to the driver's headrest and to the driver's ear in order to detect movement of the driver's head a predetermined distance in a forward or rearward direction for activating a sounding an alarm if a driver dozes or falls asleep at the wheel of a moving vehicle while driving as shown in the present invention.

An object of the present invention is to provide a sleep prevention device while driving that has a retractable and an extendable cord for moving a predetermined amount between two electrical contacts in order to set off an alarm in either a first forward position or in a second rearward position which allows the quick awakening of a dozing or sleepy driver.

Another object of the present invention is to provide a sleep prevention device while driving that can be neatly hidden in the driver's headrest or neatly obscured on the driver's backrest of the vehicle.

Another object of the present invention is to provide a sleep prevention device while driving that has an ear attachment element for the driver that is light-weight, adjustable, attachable to glasses and has an alarm mechanism within the ear attachment element.

Another object of the present invention is to provide a sleep prevention device that is simple to install and use having a minimum amount of moving parts, is light-weight and easy to maintain.

Another object of the present invention is to provide a sleep prevention device that can be mass produced in an automated and economical manner and is readily affordable by the consumer.

SUMMARY OF THE INVENTION

In accordance with the present invention, there is provided a sleep prevention device while driving a vehicle. The sleep prevention device includes a housing member having an interior compartment; the interior compartment has a movable cord member with a distal end and a proximal end and a first contact member thereon. The interior compartment also includes two spaced-apart second contact members for engagement by the first contact member. The sleep prevention device further includes an earpiece assembly having an earpiece housing member with an alarm member therein connected to a speaker member in the earpiece housing. The distal end of the movable cord member is connected to the earpiece assembly. The first contact member moves in either a forward direction or a rearward direction as the driver's head moves as the driver starts to doze or fall asleep such that the first contact member moves and engages one of the second contact members in order to activate the alarm member and produces an alarm sound in the driver's ear from the speaker member of the alarm member for awakening the driver from his/her dozing or sleeping state.

In an alternate embodiment, a sleep prevention device while driving a vehicle includes a bracket holding member having an adjustable bracket member and a bar member with a bar distal end and a bar proximal end. The bar proximal end of the bar member is attached to the adjustable bracket member; and the adjustable bracket member is used for detachably holding a coil member thereon. The bar distal end of the bar member is attached to a cord tab member. The coil member includes a movable cord member with a cord distal end and a cord proximal end, and cord proximal end having a first contact member thereon. The bar member includes two spaced-apart second contact members thereon for engagement by the first contact member. The sleep prevention device includes an earpiece assembly including an earpiece housing member having a speaker member in the earpiece housing. The distal end of the movable cord member is connected to the earpiece assembly. The first contact member moves in either a forward direction or a rearward direction as the driver's head moves as the driver starts to doze or fall asleep such that the first contact member moves and engages one of the second contact members in order to activate the alarm member and produces an alarm sound in the driver's ear from the speaker member of the alarm member for awakening the driver from his/her dozing or sleeping state.

In a further alternate embodiment, a sleep prevention device while driving a vehicle includes a housing member having an interior compartment; the interior compartment includes a first electronic eye for producing a first stationary sensor beam, a second electronic eye for producing a second moving sensor beam, a third electronic eye for producing a third stationary sensor beam, a first sensor beam detector and a second sensor beam detector. The second moving sensor beam of the second electronic eye is programmed to move a predetermined distance in a forward direction or a rearward direction in order to indicate when a driver's head has moved to a dozing or sleeping state. The interior compartment includes an alarm member, a speaker member connected to the alarm member, and a CPU chip; the CPU chip for activation of the alarm member and movement of the second moving sensor beam. The moving sensor beam is used for electronically activating the first sensor beam detector and the first stationary beam as the driver's head moves in the rearward direction in order to activate the alarm member to produce the alarm sound from the alarm member for awakening the dozing or sleeping driver as the alarm sound is generated from the speaker member. The moving sensor beam is also used for electronically activating the second sensor beam detector and the third stationary beam as the driver's head moves in the rearward direction in order to activate the alarm member to produce the alarm sound from the alarm member for awakening the dozing or sleeping driver as the alarm sound is generated from the speaker member. Further, the moving sensor beam moves back to its original vertical position when the driver's head moves back to a vertical position in order to re-arm the sleep prevention device.

BRIEF DESCRIPTION OF DRAWINGS

Further objects, features and advantages of the present invention will become apparent upon the consideration of the following detailed description of the presently preferred embodiment when taken in conjunction with the accompanying drawings, wherein.

DETAILED DESCRIPTION OF THE PREFERRED AND ALTERNATE EMBODIMENTS

Figure 1:
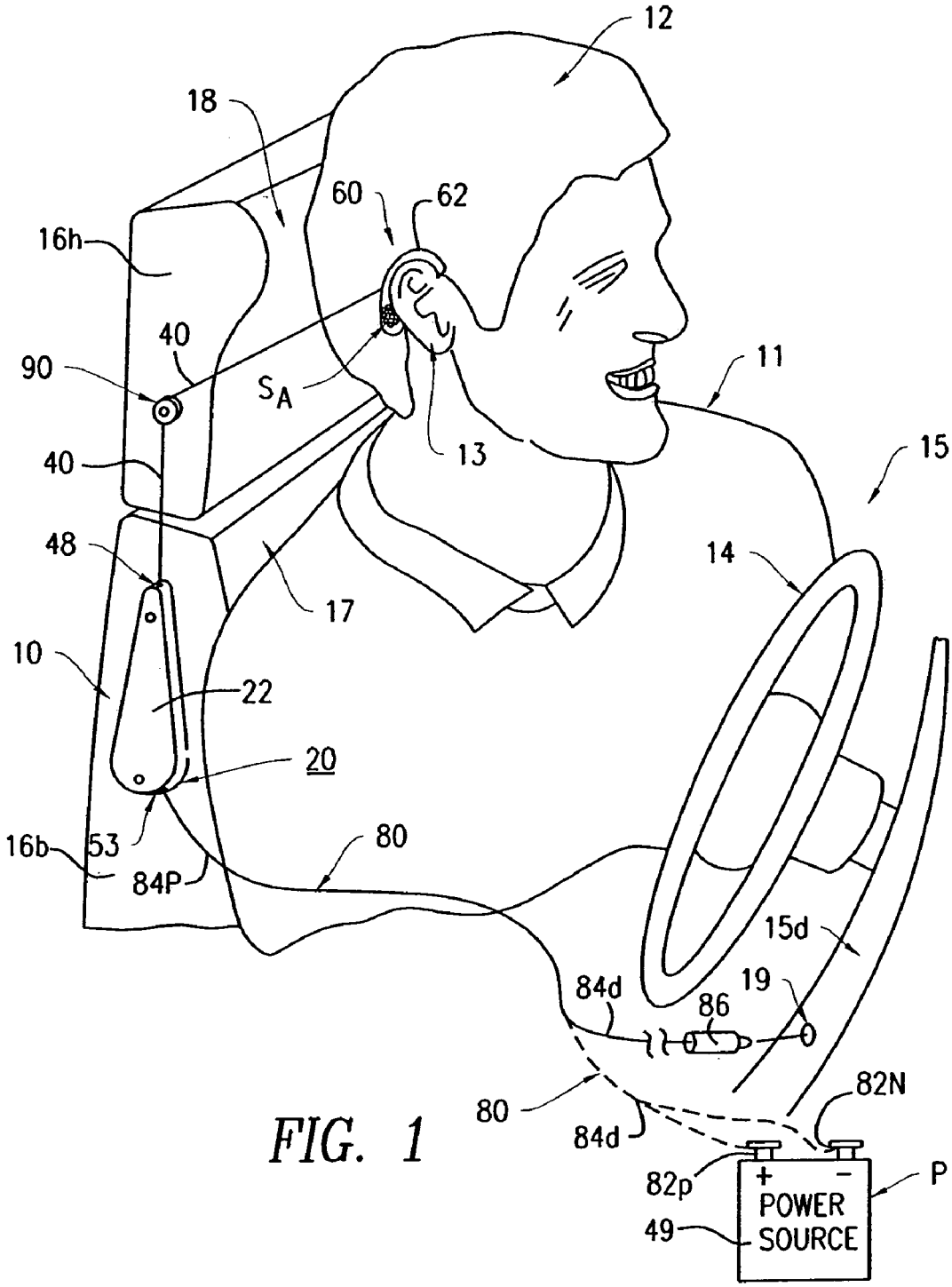
FIG. 1 is a perspective view of the sleep prevention device while driving of the preferred embodiment of the present invention showing the device in an assembled state and in operational use by a driver.

The sleep prevention devices while driving 10, 110 and 310 and their component parts of the preferred and alternate embodiments 10, 100, and 300 of the present invention are represented in detail by FIGS. 1 through 9 of the patent drawings. The sleep prevention devices while driving 10, 110 and 310 are used to detect the movement of the driver's head 12 in a forward or rearward direction $M_F$ or $M_R$ for sounding an alarm if the driver 11 should doze or fall asleep at the steering wheel 14 of a vehicle 15 when driving.

Preferred Embodiment 10

Figure 2:
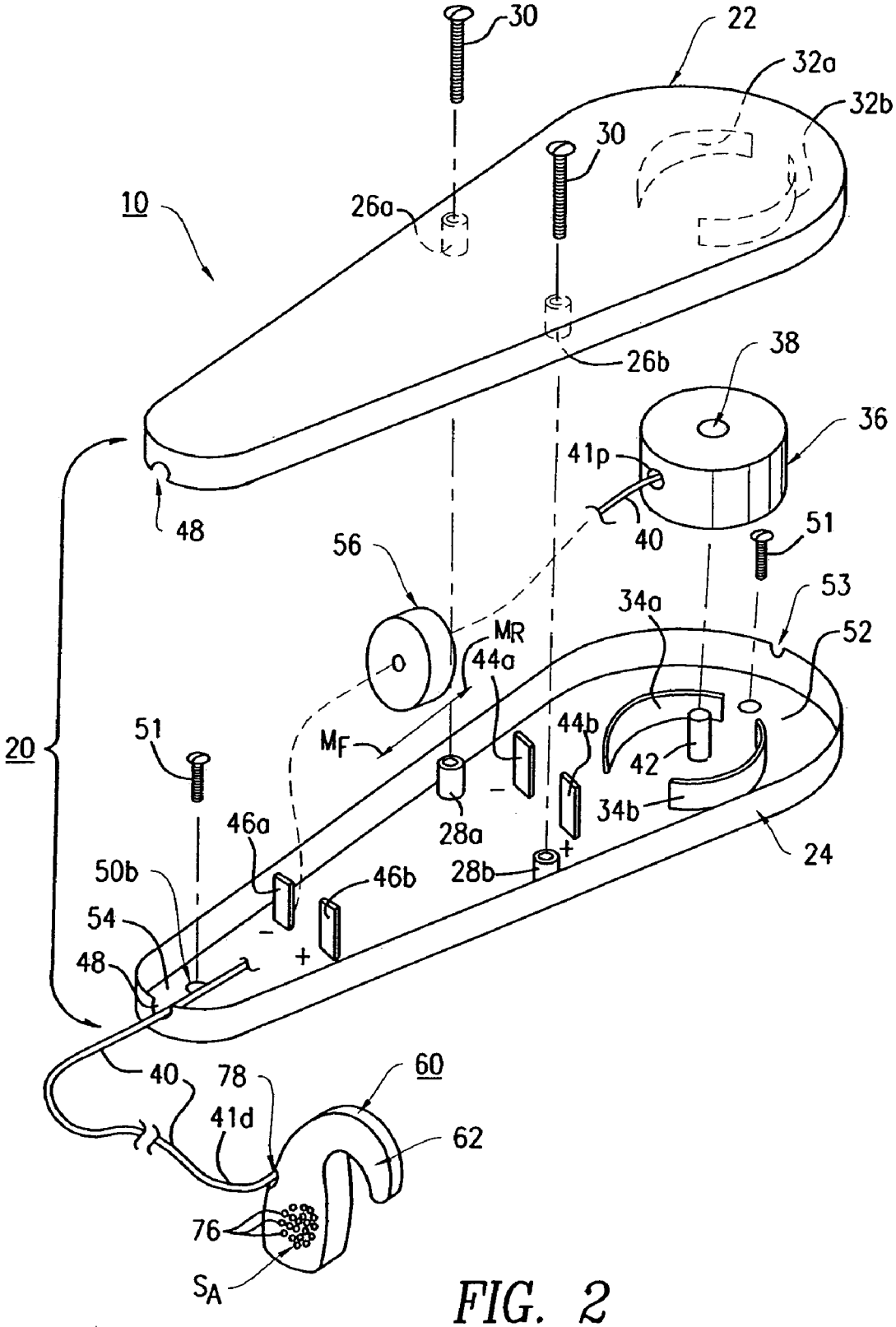
FIG. 2 is an exploded perspective view of the sleep prevention device while driving of the preferred embodiment of the present invention showing the major component parts contained therein.
Figure 3A:
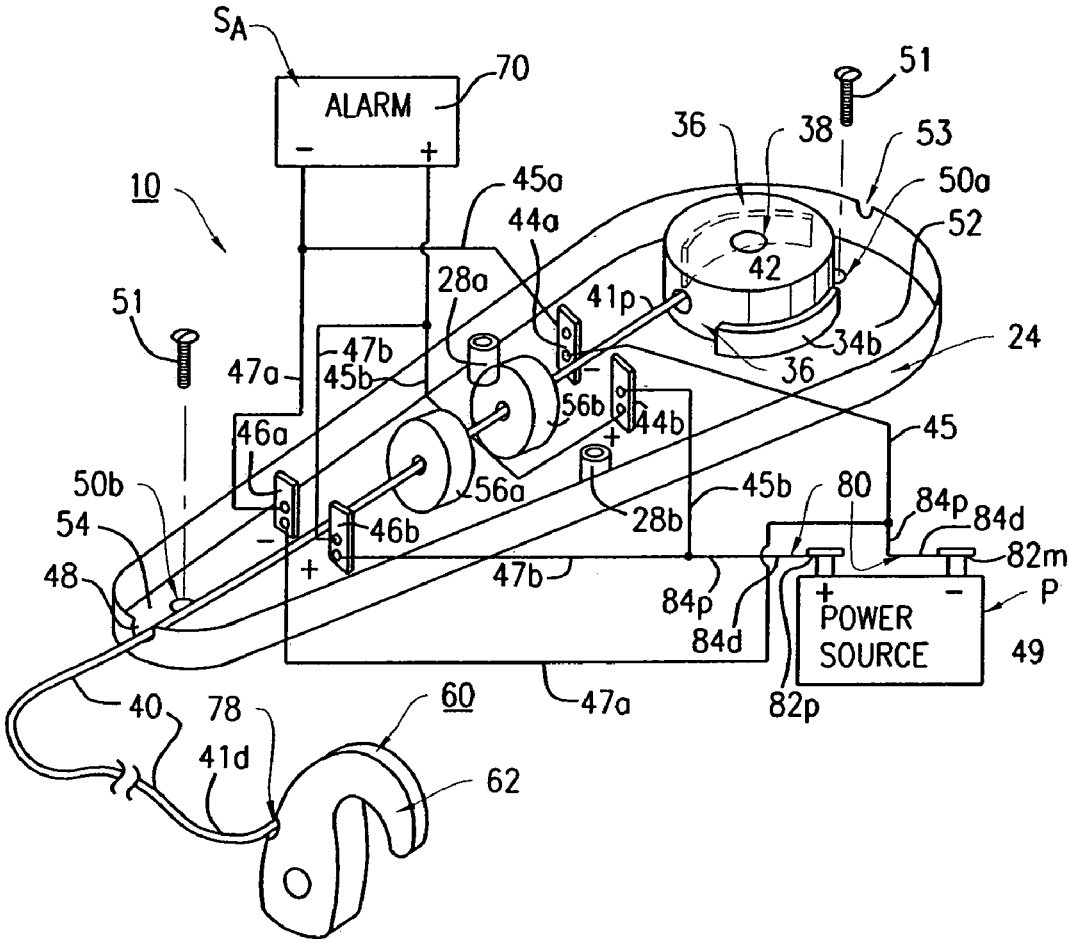
FIG. 3A is a perspective view of the sleep prevention device while driving of the present invention showing electrical wiring connected to two sets of spaced-apart metal guide posts for powering an alarm member from a power source.
Figure 3B:
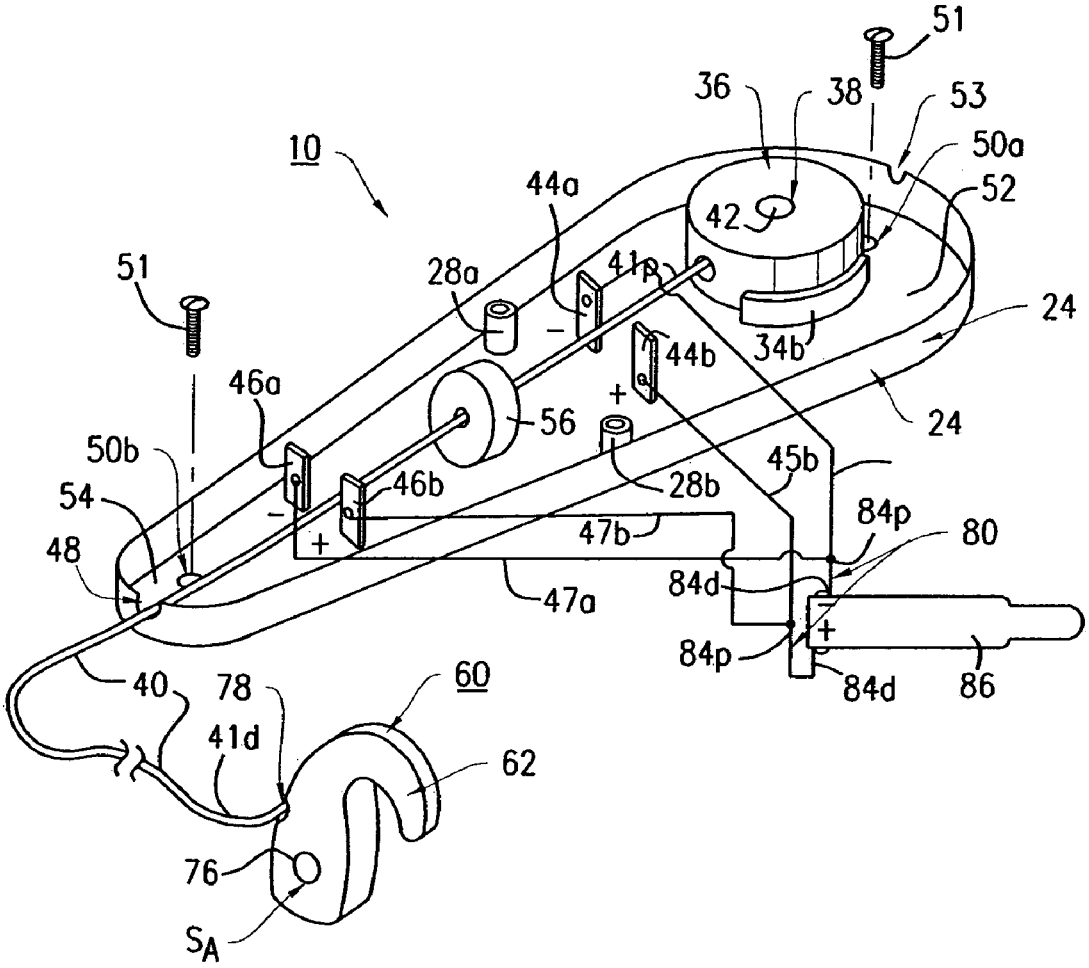
FIG. 3B is a perspective view of the sleep prevention device while driving of the present invention showing electrical wiring connected to two sets of spaced-apart metal guide posts for powering the alarm member within an earpiece assembly from an electrical power adapter.
Figure 6:
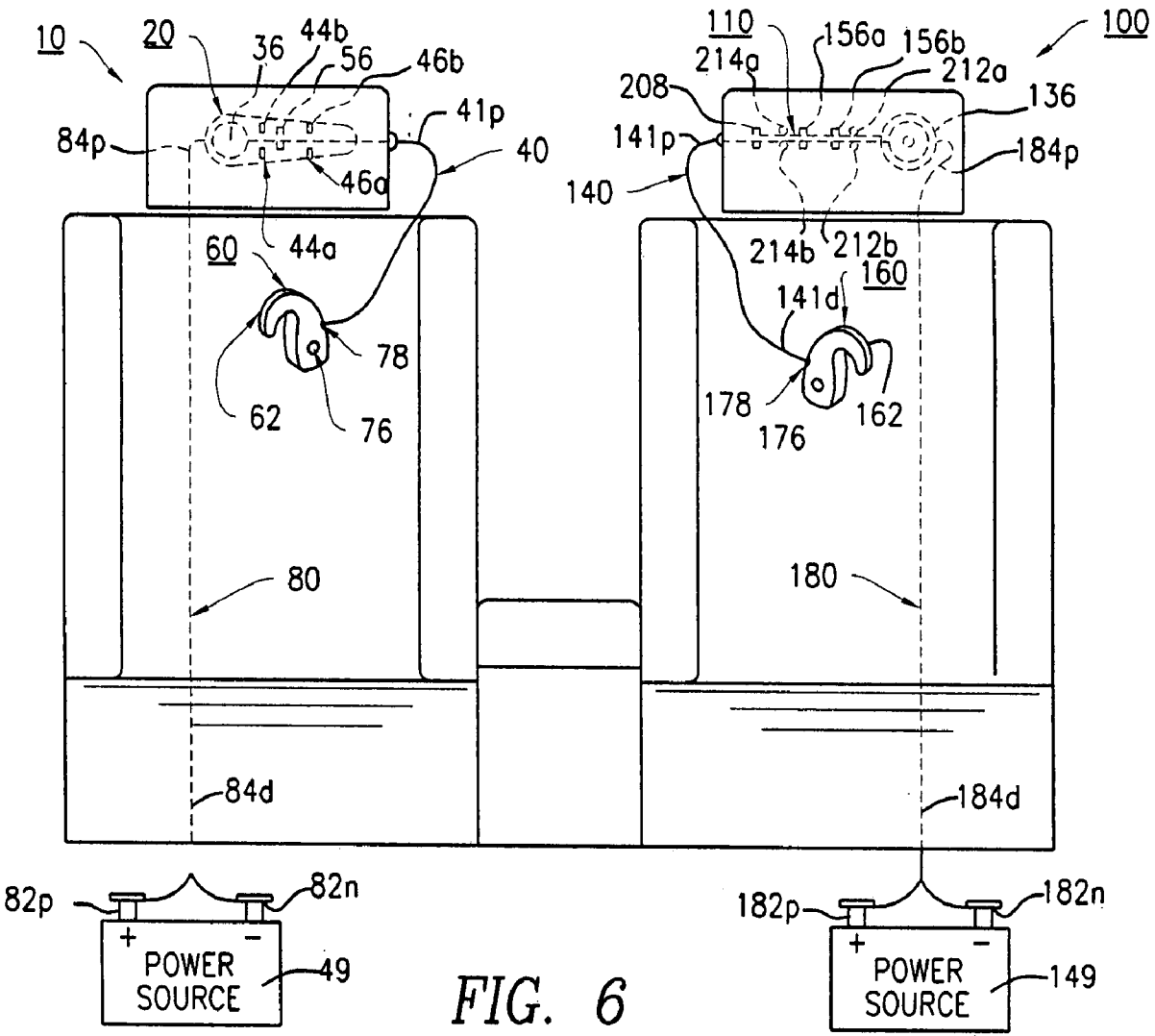
FIG. 6 is a perspective view of the sleep prevention device while driving of the present invention showing the preferred and first alternate devices in an assembled state within each of a passenger or drivers headrest of the vehicle's seats and being readied for an operational mode.
Figure 7:
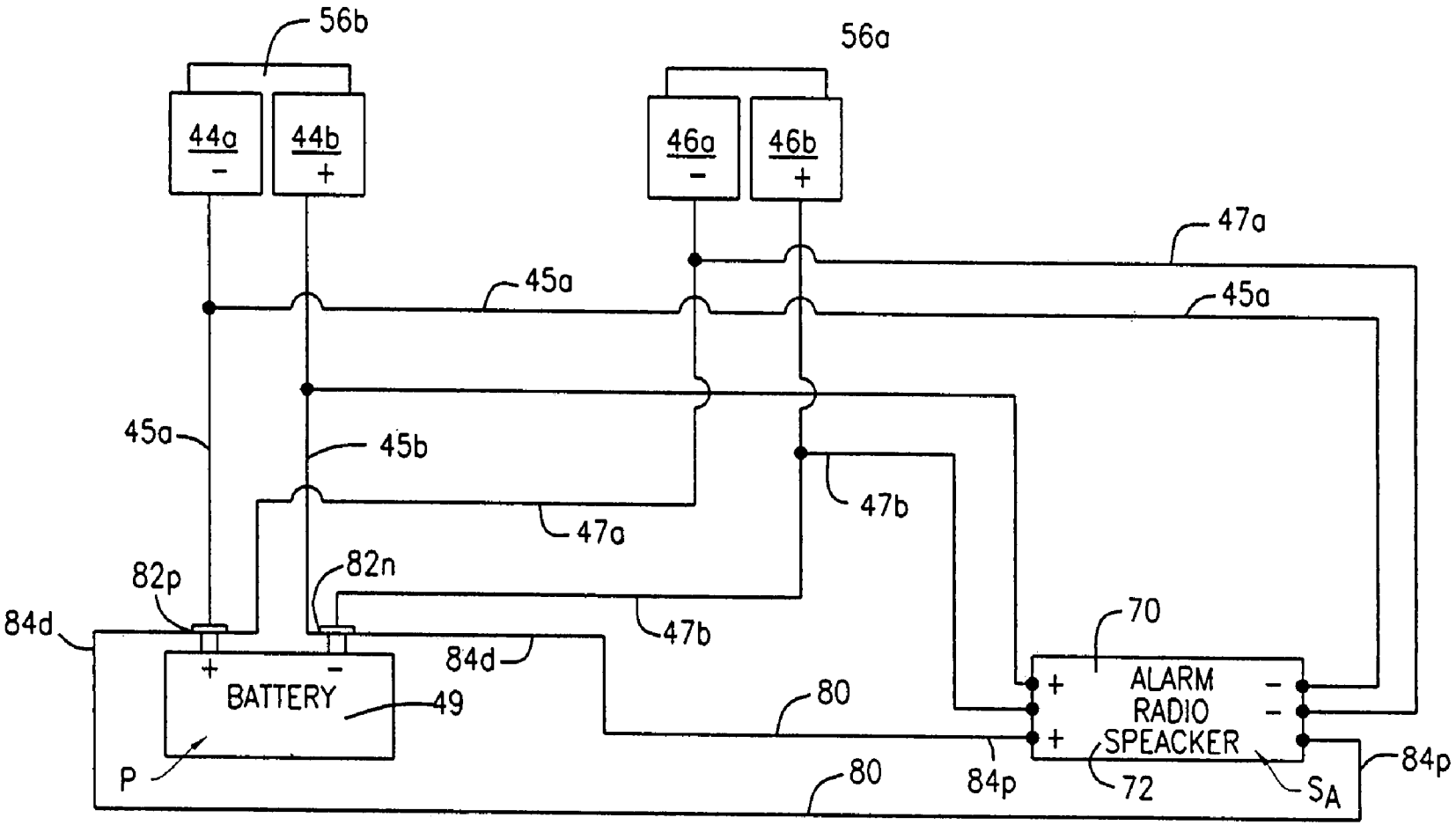
FIG. 7 is an electrical schematic block diagram of the sleep prevention device of the present invention showing its electrical connections to a power source, an alarm mechanism, and a pair of electrical contact members being activated by a contact ring/bar.

As shown in FIGS. 1 to 3, the sleep prevention device 10 includes a housing member 20 having a first (top) section 22 and a second (bottom) section 24. Housing member 20 is made of metal or plastic materials. Each of the sections 22 and 24 of the housing member 20 include upper and lower locking and connecting members 26*a*, 26*b*, 28*a* and 28, respectively, for receiving connecting screws 30. Each of the sections 22 and 24 include upper and lower coil mounting brackets 32*a*, 32*b*, 34*a* and 34*b*, for receiving a coil member 36 having a center post opening 38 and having an extendable string/cord member 40 extending from the coil 36 having a distal end 41*d* and proximal end 41*p*. Cord member 40 may be made of fiber materials, flexible plastic materials or flexible metal wire materials. Bottom section 24 includes a center post 42. Center post opening 38 of coil member 36 is for receiving and mounting to the center post 42 in order to mount the coil member 36 within the coil mounting brackets 32*a*, 32*b*, 34*a* and 34*b*, as depicted in FIGS. 2 and 3A of the drawings. The bottom section 24 also includes two sets of spaced-apart metal guide posts 44*a*, 44*b* and 46*a*, 46*b* thereon, for use in the extending and guiding the extendable string/cord member 40 through a string opening 48 of housing member 20. Each of the spaced-apart metal guide posts 44*a*, 44*b*, 46*a* and 46*b* include corresponding connector wires 45*a*, 45*b*, 47*a* and 47*b*, respectively, thereon for electrically connecting via wire conduit opening 53 to an alarm member 70 and a power source 49, such as a 12 volt battery in a vehicle 15, as depicted in FIGS. 3A and 7 or for electrically connecting to an electrical power adapter 86, as depicted in FIG. 3B. Bottom section 24 further includes mounting openings 50*a* and 50*b* at opposing ends 52 and 54, respectively, of bottom section 24 in order to mount the housing member 20 to a side 16 of a driver's backrest 17 of a vehicle 15. In alternate design configuration, housing member 20 can be positioned within a passenger's headrest 18 of the vehicle 15, as shown in FIG. 6 of the drawings. String or cord member 40 includes a pair of spaced-apart contact members 56*a* and 56*b* positioned between each of the spaced-apart metal guide posts 44*a*, 44*b* and 46*a*, 46*b*, respectively, within housing member 20, as shown in FIG. 3A of the drawings. Contact members 56*a* and 56*b* are used to activate an alarm member 70 within an earpiece assembly 60. In an alternate design configuration, as shown in FIG. 3B, string/cord member 40 includes a single contact member 56 being positioned between each of the spaced-apart metal guide posts 44*a*, 44*b* and 46*a*, 46*b*, respectively, as the single contact member 56 is used to activate the alarm member 70 within the earpiece assembly 60. The alarm member 70 can be directly connected to the vehicle's radio or on the vehicles dashboard 15*d*, such that the alarm member is not in the earpiece.

The sleep prevention device 10 further includes an earpiece assembly 60 connected to the housing member 20 via the distal end 41*d* of cord member 40, as shown in FIGS. 2, 3A, 3B and 3C of the drawings. The earpiece assembly 60 is used for activating an alarm sound $S_A$ in the driver's ear 13 in response to forward or rearward movement $M_F$ or $M_R$ of the driver's head 12. As the head moves, the cord moves, and the contact members 56*a* and 56*b* or 56 on the cord members 40 move and engage one of two sets of the spaced-apart metal guide posts 44*a*, 44*b* and 46*a*, 46*b* of the housing member 20.

Figure 3C:
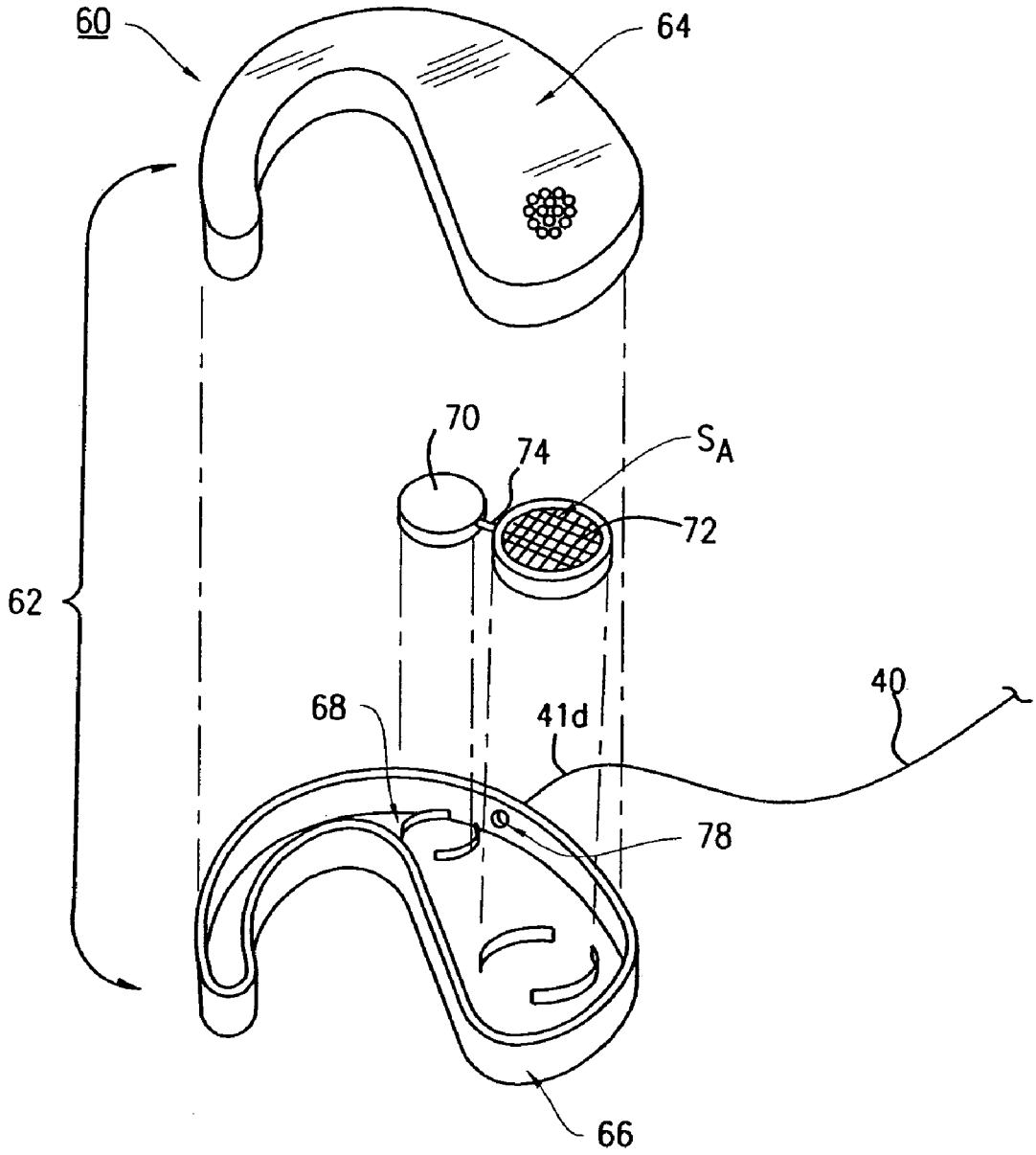
FIG. 3C is an exploded perspective view of the sleep prevention device while driving of the present invention showing the alarm member connected to a speaker member.
Figure 4:
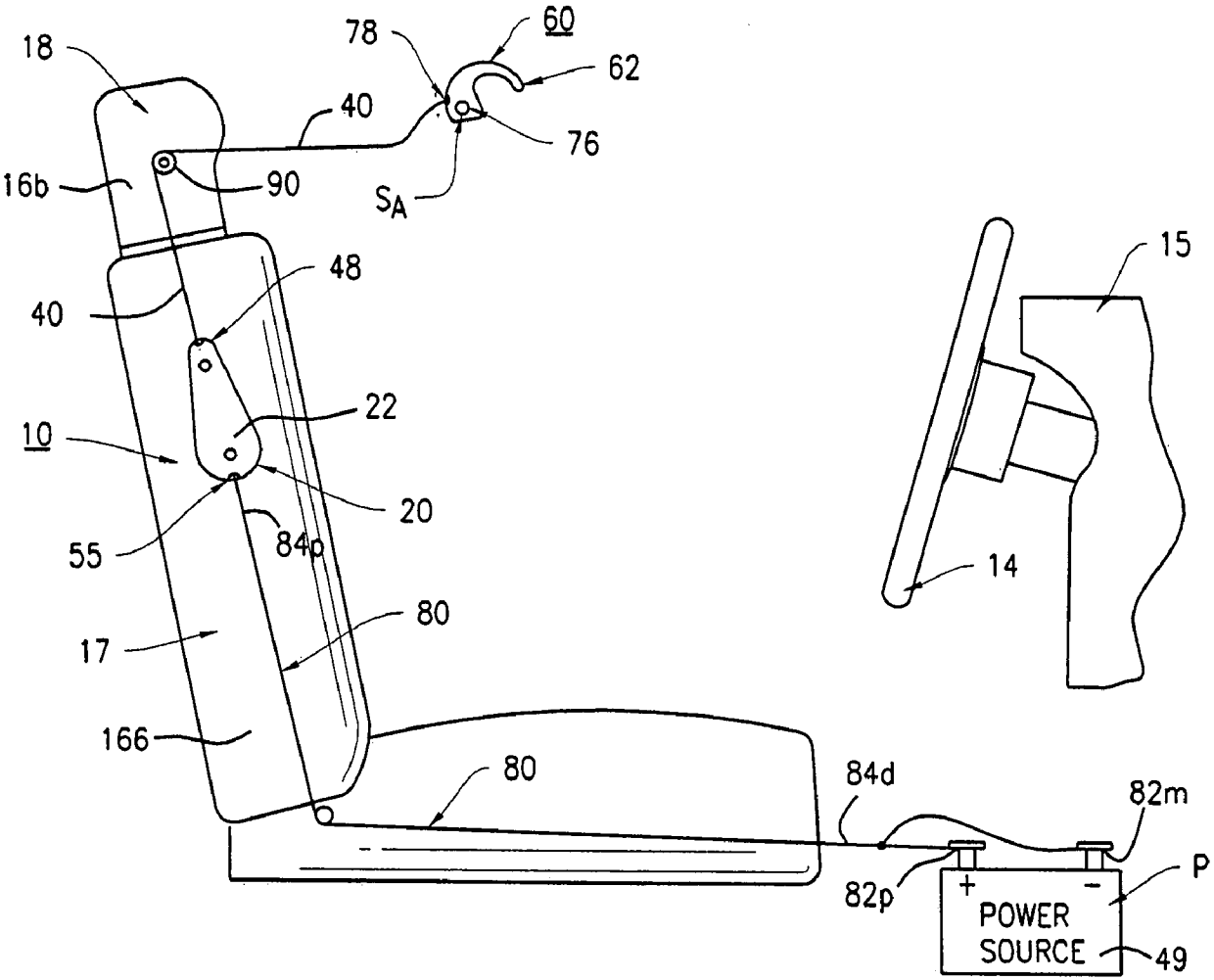
FIG. 4 is a side elevational view of the sleep prevention device while driving of the present invention showing the device in an assembled state on a backrest of a driver's seat and being readied for an operational mode by a driver.

The earpiece assembly 60, as shown in FIGS. 2 and 3C, include an earpiece housing member 62 having a first earpiece section 64 and a second earpiece section 66 for forming an interior compartment 68. The interior compartment 68 includes an alarm member 70 and a speaker member 72 being electrically connected to each other via electrical connection wire 74. The earpiece housing member 62 also includes a plurality of speaker openings 76 for transmitting the alarm sound $S_A$ of alarm member 70 from speaker member 72. The earpiece housing member 62 further includes a cord connection opening 78 for receiving the distal end 41*d* of cord member 40. The connector wires 45*a*, 45*b*, 47*a* and 47*b* form an electrical connector conduit 80 having a distal end 84*d* and a proximal end 84*p* thereon. The connector conduit 80 also includes a positive connector wire 82*p* and a negative connector wire 82*n*. The proximal end 84*p* of electrical connector conduit 80 is for electrically connecting to the alarm member 70 and the distal end 84*d* of electrical connector conduit 80 is for electrically connecting to an electrical power adapter 86 for supplying power P from a cigarette plug receptacle 19 on the dashboard 15*d* of vehicle 15, as well as having the positive and negative connector wires 82*p* and 82*n* being attached to the power source 49. The power source 49 may be a car battery, a fuse box or a battery power pack. Additionally, the earpiece housing member 62 includes holding tab 88 for attachment of the earpiece assembly 60 to the driver's eye glass frame (not shown), as shown in FIG. 3C. The sleep prevention device 10 also includes a pulley member 90 being attached to the side 16 of the driver's backrest 17 or headrest 18 for changing the direction of the cord member 40 at an angle of at least 90° for more easily accessing the earpiece assembly 60 on the driver's ear 13, as shown in FIGS. 4 and 6 of the drawings.

First Alternate Embodiment 100

The sleep prevention device 110 and its component parts of the first alternate embodiment 100 of the present invention are represented in detail by FIGS. 5, 5A, 5B and 6 of the patent drawings. Elements illustrated in FIGS. 5, 5A and 5B which correspond to the elements described above with reference to FIGS. 1 through 4 have been designated by corresponding reference numbers increased by one hundred. The first alternate embodiment 100 is constructed in a similar manner and operates in the same manner as the preferred embodiment 10, unless it is otherwise stated.

Figure 5:
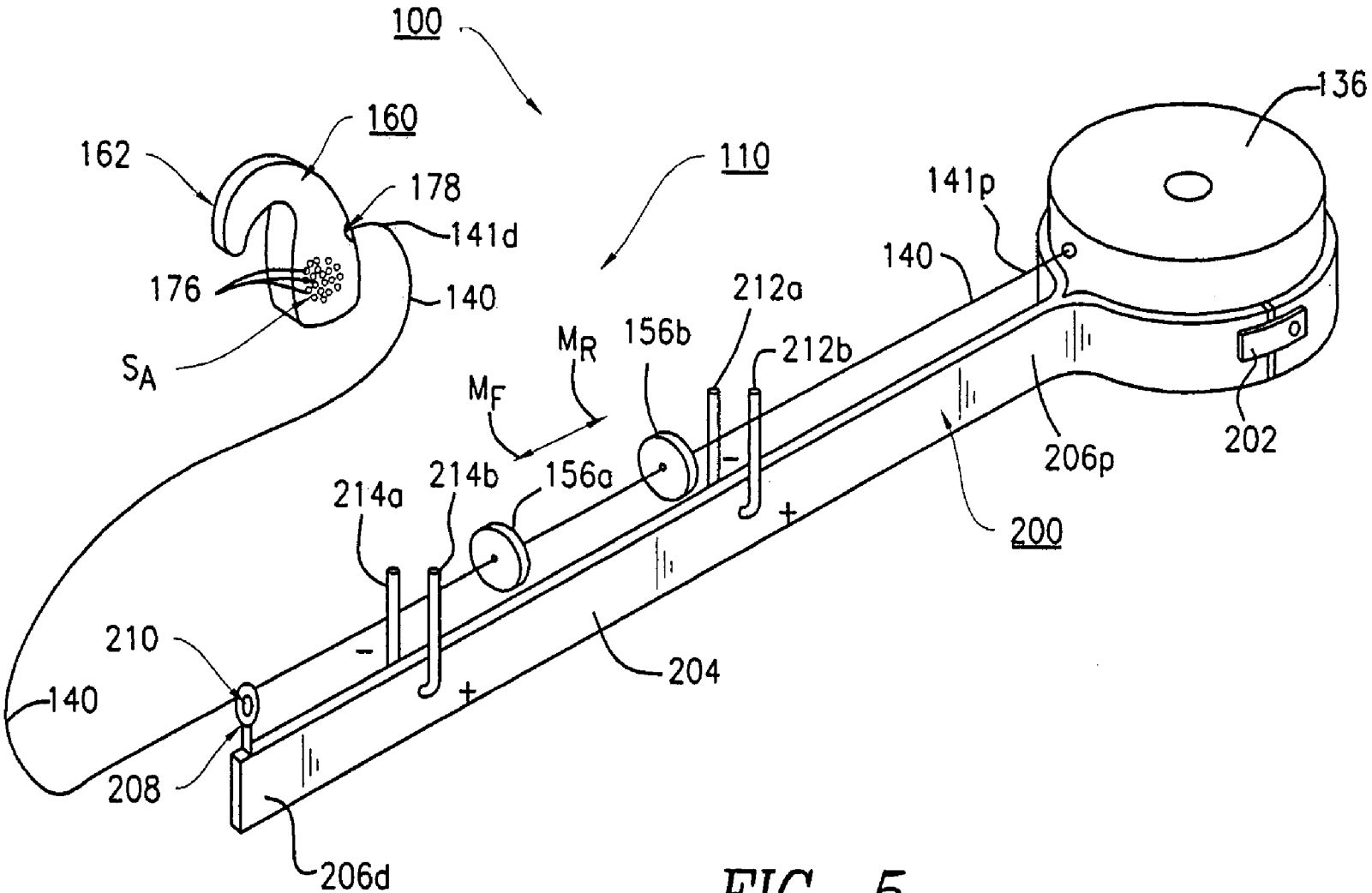
FIG. 5 is a perspective view of the sleep prevention device while driving of the first alternate embodiment of the present invention showing the major component parts contained thereto without wiring.
Figure 5A:
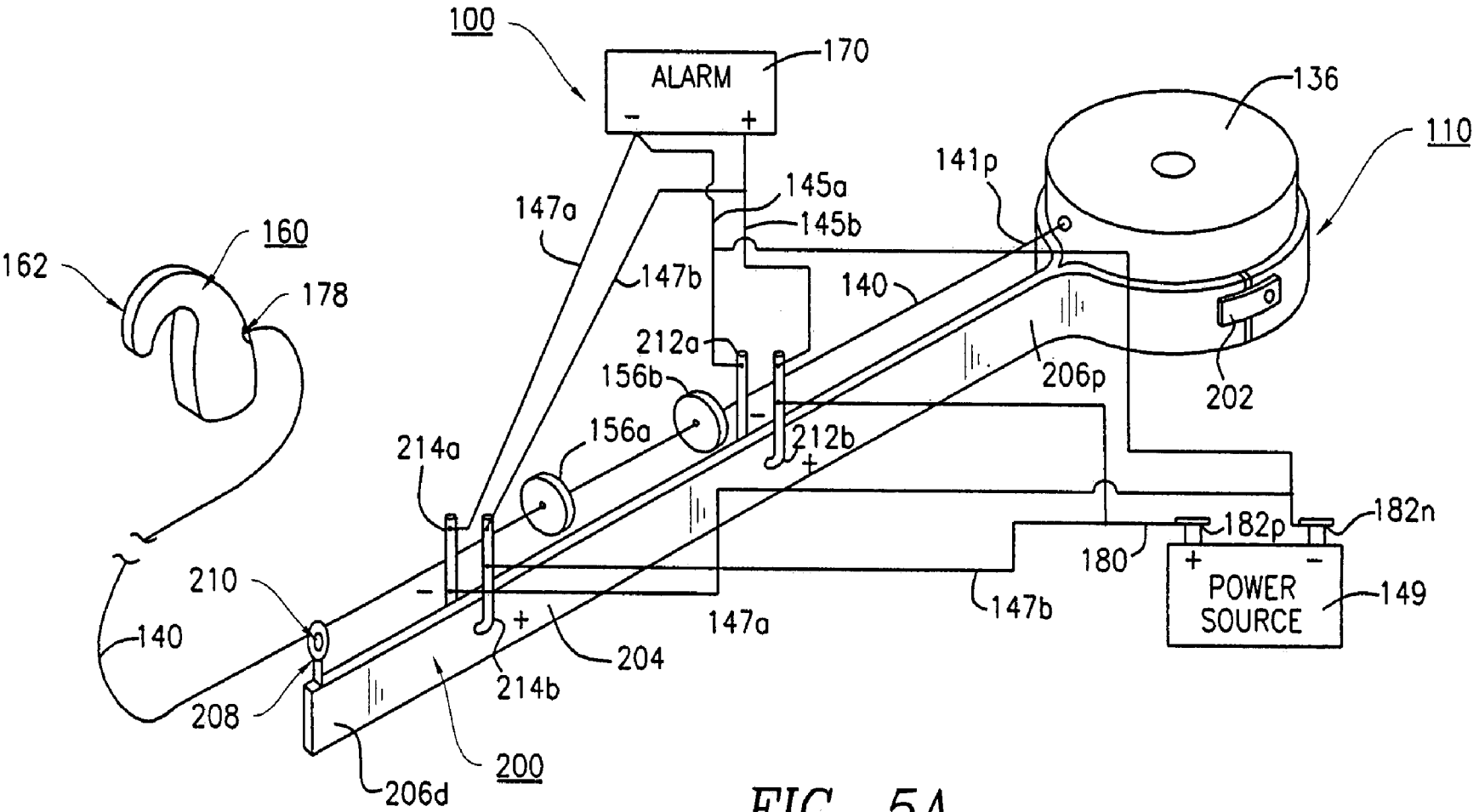
FIG. 5A in a perspective view of the sleep prevention device while driving of the first alternate embodiment of the present invention showing electrical wiring connected to two sets of spaced-apart metal guide posts for the alarm member from the power source.
Figure 5B:
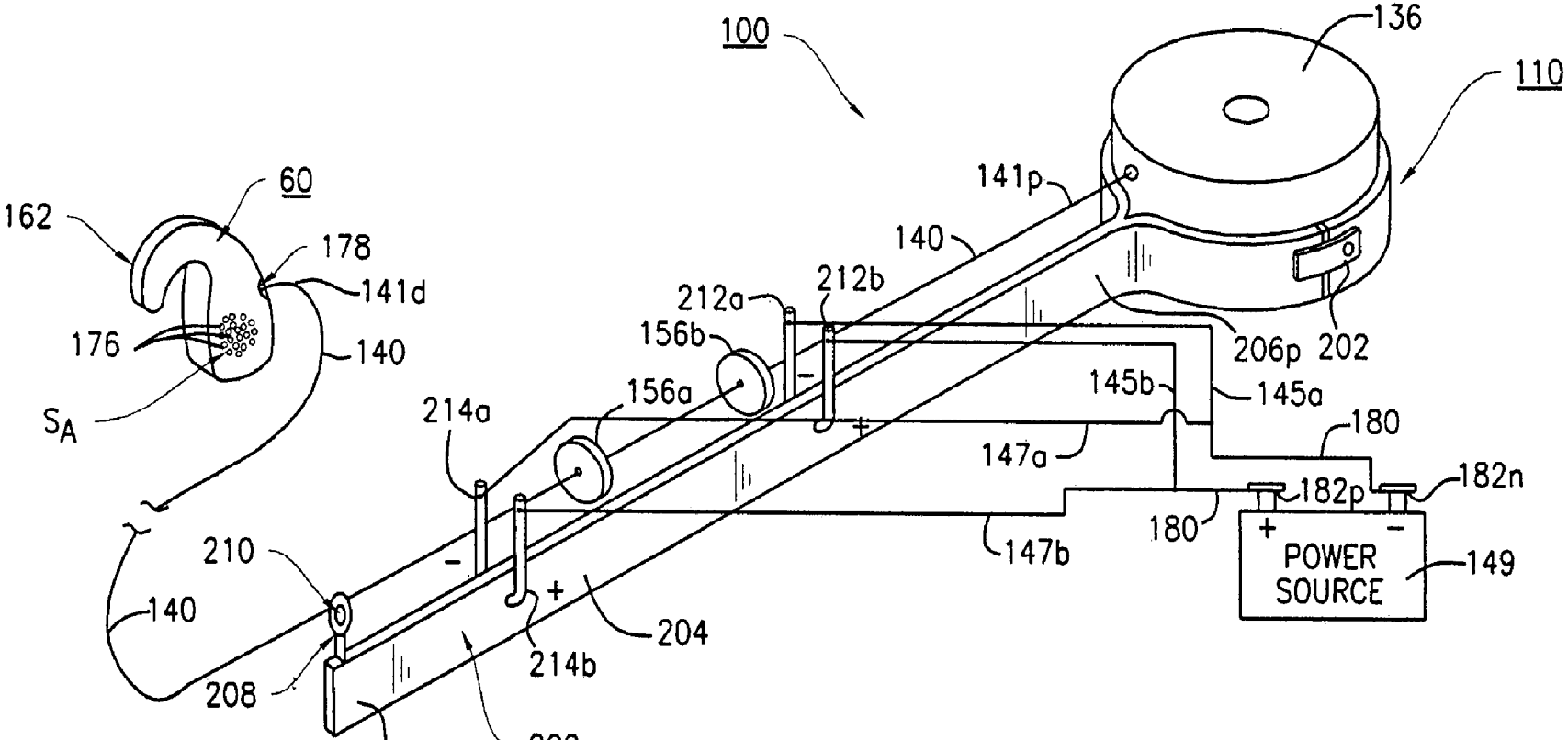
FIG. 5B is a perspective view of the sleep prevention device while driving of the first alternate embodiment of the present invention showing electrical wiring connected to two sets of spaced-apart metal guide posts for powering the alarm member within the earpiece assembly from the electrical power adapter.

The first alternate embodiment 100 is almost the same as the preferred embodiment of the sleep prevention device 10, except for the configuration and structure of a bracket holding member 200 for holding the coil member 136 in place. The bracket holding member 200 includes an adjustable bracket member 202, a bar member 204 having a proximal end 206*p* and a distal end 206*d*, and a cord tab member 208 having a cord opening 210 therein. The proximal end 206*p* of the bar member 204 is integrally attached to the adjustable bracket member 202 and the distal end 206*d* of bar member is integrally attached to the cord tab member 208. Bar member 204 also includes two sets of spaced-apart metal guide posts 212*a*, 212*b* and 214*a*, 214*b*. Each of the metal guide posts 212*a*, 212*b*, 214*a* and 214*b* are L-shaped and detachably connected to the bar member 204, as depicted in FIG. 5 of the drawings. The remaining component parts of the sleep prevention device 110 are the same as the component parts of sleep prevention device 10 of the preferred embodiment.

Second Alternate Embodiment 300

Figure 8:
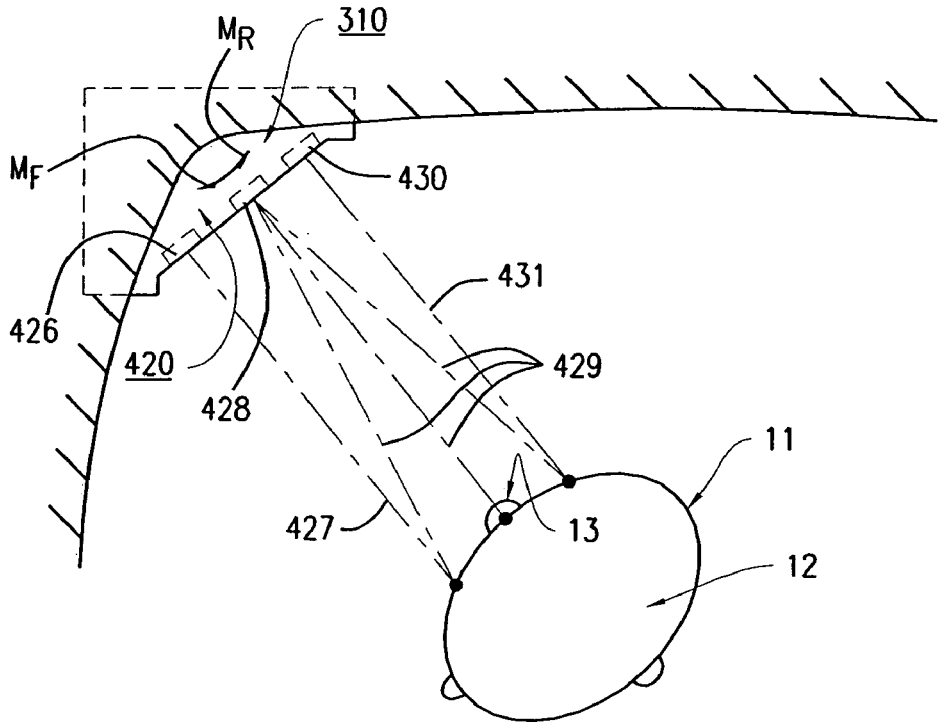
FIG. 8 is a top plan view of the sleep prevention device while driving of the second alternate embodiment of the present invention showing the device in an assembled state and in an operational mode thereof.
Figure 9:
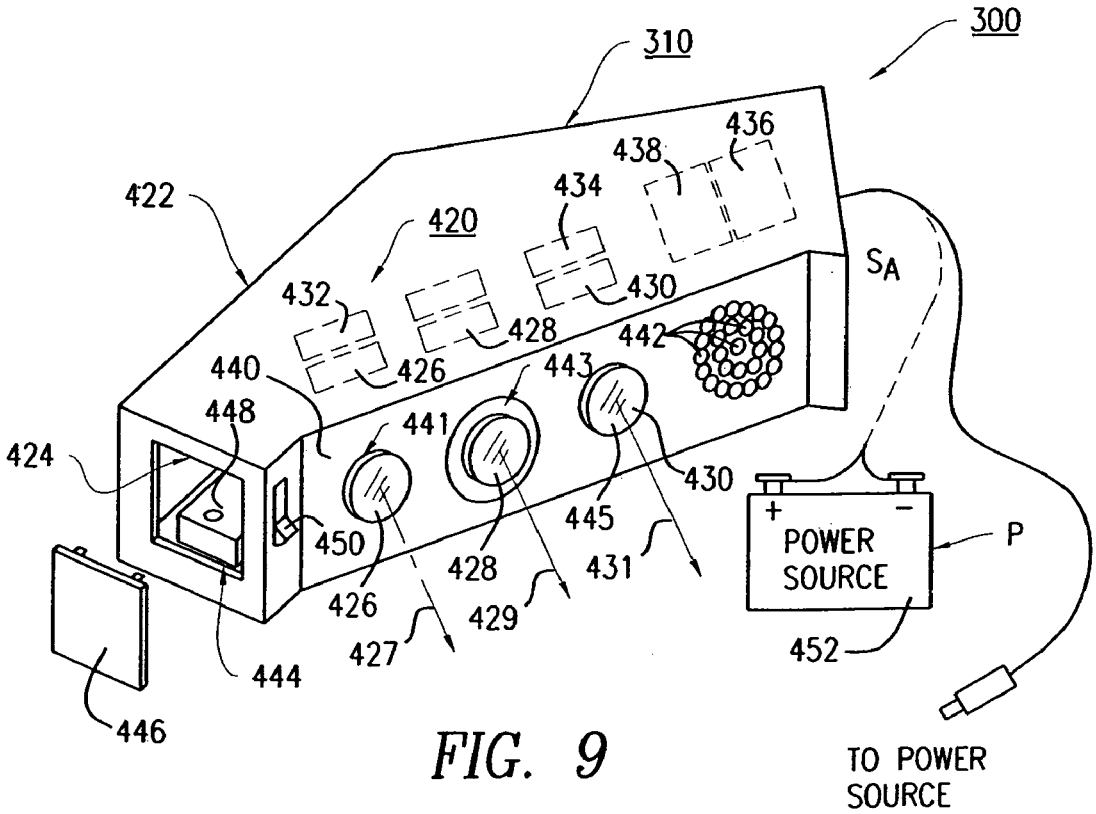
FIG. 9 is a perspective view of the sleep prevention device of the second alternate embodiment of the present invention showing the major component parts contained therein.

The sleep prevention device 310 and its component parts of the second alternate embodiment 300 of the present invention are represented in detail by FIGS. 8 and 9 of the patent drawings. The sleep prevention device 310 includes a sensor assembly 420 for the detection of the movement of the driver's head 12 a predetermined distance in a forward or rearward direction (movement $M_F$ or $M_R$) in order to produce alarm sound $S_A$ from an alarm member 70 if the driver dozes or falls asleep at the wheel 14 of the vehicle 15 while driving.

The sensor assembly 420 includes a housing member 422 having an interior compartment 424. The interior compartment 424 of housing member 422 includes a first electronic eye 426 for producing a first stationary sensor beam 427, a second moving electronic eye 428 for producing a second moving sensor beam 429, a third electronic eye 430 for producing a third stationary sensor beam 431, a first sensor beam detector 432 and a second sensor beam detector 434. The second moving sensor beam 429 has been programmed to move a predetermined distance in a forward or rearward direction (movement $M_F$ or $M_R$) in order to indicate when the driver's head 12 has moved to a dozing or sleeping state. The first, second and third sensor beams 427,429 and 431 are UV sensor beams or IR sensor beams being invisible to the naked eye.

The interior compartment 424 of housing member 422 further includes an alarm member 436 and a speaker member 438. Housing member 422 also includes a front wall 440 having a plurality of speaker openings 442 therein for transmitting the alarm sounds of alarm member 436 from speaker member 438. Front wall 440 also includes a first wall opening 441 for the first electronic eye 426, a second wall opening 443 for the second electronic eye 428 and a third wall opening 445 for the third electronic eye 430. The first sensor beam detector 432 is electronically aligned with the first stationary beam 427 of the first electronic eye 426 in order to detect movement of the second moving sensor beam 429 of the second moving electronic eye 428. As the second moving sensor beam 429 moves in a forward direction $M_F$ and intercepts the first stationary beam 427 of the first electronic eye 426 it activates the alarm member 436 to produce the alarm sound $S_A$ in order to awake the dozing or sleeping driver. Correspondingly, the second sensor beam detector 434 is electronically aligned with the third stationary sensor beam 431 of the third electronic eye 430 in order to detect movement of the second moving sensor beam 429 of the second moving electronic eye 428. As the second moving sensor beam 429 moves a predetermined distance in a rearward direction $M_R$ and intercepts the third stationary beam 431 of the third electronic eye 430 it activates the alarm member 436 to produce the alarm sound $S_A$ in order to awake the dozing or sleeping driver. Additionally, the interior compartment 424 also includes a battery compartment 444 and compartment cover 446 for receiving one or more batteries 448 therein, as a power source P, and an on-off power switch 450. The batteries 448 are used for providing power P to alarm member 436, as well as to all electronic eyes 426, 428 and 430 and sensor beam detectors 432 and 434. Alternatively, alarm member 436 and all sensors may be directly connected electronically to the vehicle's 12 volt battery 452 as its power source P.

Operation of the Present Invention

Upon installation of the sleep prevention devices 10, 110 and 310 within vehicles 15 by manufacturers or as an after market product, as previously described in the above, the sleep prevention devices 10, 110 and 310 operate in the following manner, as shown in FIGS. 1 through 9 of the patent drawings. In preparation of a driver 11 for operating a moving vehicle 15, the driver extends the distal end 41*d* or 141*d* of the cord members 40 or 140 and detachably connects the distal end 41*d* or 141*d* of the cord members 40 or 140 to the first connection opening 78 or 178 of the earpiece housing member 62 or 162 of earpiece assembly 60 or 160. The driver now detachably connects the proximal end 84*p* or 184*p* of the electrical connector wires 45*a*, 45*b*, 47*a*, 47*b* or 145*a*, 145*b*, 147*a*, 147*b* of the electrical connector conduit wire 80 or 180 to the power source 49 for electrically connecting to the alarm member 70 or 170; or detachably connects the electrical power adapter 86 or 186 at the distal end 84*d* or 184*d* of the electrical connector conduit wire 80 or 180 to the cigarette plug receptacle 19 on the dashboard 15*d* of vehicle 15. With the aforementioned connections completed, the driver 11 now attaches the earpiece housing member 62 or 162 of the earpiece assembly 60 or 160 to the driver's ear 13. If the driver 11 wears eyeglasses, the driver would then attach the holding tab 88 or 188 of the earpiece assembly 60 or 160 to the eyeglasses frame.

The sleep prevention devices 10 and 110 are now in an operational mode, as shown in FIGS. 3A, 3B, 5A and 5B. If the driver 11 of moving vehicle 15 should doze or fall asleep at the wheel 14 the following operation occurs within housing member 20 or on bracket holding member 200. As driver dozes off and the driver's head moves forward or back, the cord member 40 or 140 moves forward or back, in response, the spaced-apart contact members 56*a* or 156*a* and 56*b* or 156*b* move in either a forward direction $M_F$ or a rearward direction $M_R$ as the driver's head 12 starts to doze or falls asleep. The contact member 56*a* or 156*a* contacts the metal guide posts 44*a*, 44*b* or 144*a*, 144*b* when the cord members 40 or 140 moves in the forward direction $M_F$ for activating the alarm sound $S_A$ in the driver's ear 13 from the speaker member 72 of alarm member 70 in order to waken the driver 11 from his/her dozing or sleeping state. Correspondingly, if the driver starts to doze or falls asleep such that the driver's head moves back, the contact member 56*b* or 156*b* contacts the metal guide posts 46*a*, 46*b* or 146*a*, 146*b* when moving in the rearward direction $M_R$ for activating the alarm sound $S_A$ in the driver's ear 13 from the speaker member 72 of alarm member 70 in order to waken the driver 11 from his/her dozing or sleeping state.

The sleep prevention device 310 is installed as an after market product and is positioned within an appropriate location in the interior area of the vehicle 15. The sleep prevention device 310 becomes operational when the driver 11 starts-up the vehicle 15 being driven. As shown in FIGS. 8 and 9, if the driver 11 of moving vehicle should doze or fall asleep at the wheel 14, the following electronic operation occurs within the housing member 422 of sensor assembly 420. As the driver's head 12 moves in a forward direction $M_F$ the second moving sensor beam 429 intercepts the first stationary beam 427 of the first electronic eye 426 for activating the alarm member 436 to produce the alarm sound $S_A$ in order to awaken the dozing or sleeping driver 11 using speaker member 438. Correspondingly, as the driver's head 12 moves in a rearward direction $M_R$ the second moving sensor beam 429 intercepts the third stationary beam 431 of the third electronic eye 430 for activating the alarm member 436 to produce the alarm sound $S_A$ in order to awaken the dozing or sleeping driver 11 using speaker member 438. When driver 11 moves his/her driver's head 12 back to its original position, the moving sensor beam 429 of the second moving electronic eye 428 re-arms the sensor assembly 420 to its operational mode once again.

ADVANTAGES OF THE PRESENT INVENTION

Accordingly, an advantage of the present invention is that it provides for a sleep prevention device while driving having an alarm for awakening a dozing or sleepy driver instantaneously permitting the driver to quickly retain control of the moving vehicle.

Another advantage of the present invention is that it provides for a sleep prevention device while driving being attached to the driver's headrest and to the driver's ear in order to detect movement of the driver's head a predetermined distance in a forward or rearward direction for sounding an alarm if a driver dozes or falls asleep at the wheel of a moving vehicle while driving.

Another advantage of the present invention is that it provides for a sleep prevention device while driving that has a retractable and an extendable cord for moving a cord a predetermined amount between two electrical contacts in order to set off an alarm in either a first forward position or in a second rearward position which allows the quick awakening of a dozing or sleepy driver.

Another advantage of the present invention is that it provides for a sleep prevention device while driving that can be neatly hidden in the driver's headrest or neatly obscured on the driver's backrest of the vehicle.

Another advantage of the present invention is that it provides for a sleep prevention device while driving that has an ear attachment element for the driver being light-weight, adjustable, attachable to glasses and having an alarm member within the ear attachment element.

Another advantage of the present invention is that it provides for a sleep prevention device that is simple to install and use having a minimum amount of moving parts, is light-weight and easy to maintain.

Another advantage of the present invention is that it provides for a sleep prevention device that can be mass produced in an automated and economical manner and is readily affordable by the consumer.

Another advantage of the present invention is to provide a sleep prevention device while driving being attached to the driver's headrest and to the driver's ear in order to detect movement of the driver's head a predetermined distance in a forward or rearward direction for sounding an alarm if a driver dozes or falls asleep at the wheel of a moving vehicle while driving.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A sleep prevention device while driving a vehicle, comprising:

a) a housing member having an interior compartment;

b) said interior compartment including a movable cord member with a distal end and a proximal end, said cord member having a first contact member thereon;

c) said interior compartment including two spaced-apart second contact members for engagement by said first contact member;

d) an earpiece assembly including an earpiece housing member having an alarm member therein connected to a speaker member for producing an alarm sound in said earpiece housing member;

e) said distal end of said movable cord member being connected to said earpiece assembly; and f) said first contact member being movable in either a forward direction or a rearward direction as the driver's head moves as the driver starts to doze or fall asleep such that said first contact member engages one of said second contact members in order to activate said alarm member and produce said alarm sound in the driver's ear from said speaker member of said alarm member for awakening the driver from his/her dozing or sleeping state.

2. A sleep prevention device in accordance with claim 1, wherein said earpiece housing member includes an earpiece interior compartment, an earpiece opening for receiving said distal end of said movable cord member, and a plurality of speaker openings therein.

3. A sleep prevention device in accordance with claim 1, wherein said second contact members include two sets of spaced-apart metal guide posts, and power connection means connected to each of said two sets of spaced-apart metal guide posts.

4. A sleep prevention device in accordance with claim 3, wherein said power connection means includes an electrical connector conduit for connection to a power source.

5. A sleep prevention device in accordance with claim 3, further including an electrical power adapter connected to each of said two spaced-apart second contact members for supplying power from a cigarette plug receptacle for electrical activation of said sleep prevention device to an operational mode.

6. A sleep prevention device in accordance with claim 3, further including positive and negative connector tabs connected to each of said two spaced-apart second contact members for connecting to positive and negative connection mounts of said power source, for electrical activation of said prevention device to an operational mode.

7. A sleep prevention device in accordance with claim 1, wherein said interior compartment of said housing member includes mounting means for mounting a coil member in said housing member, said coil member for receiving said movable cord member.

8. A sleep prevention device in accordance with claim 1, wherein said housing member includes means for attaching said housing member on a seat of a vehicle.

9. A sleep prevention device in accordance with claim 1, wherein said housing member is made from plastic or metal.

10. A sleeping prevention device in accordance with claim 1, wherein said earpiece housing member includes a holding tab for attachment of said earpiece assembly to an eyeglass frame.

11. A sleeping prevention device in accordance with claim 1, wherein said cord member is made from fiber materials, plastic materials or flexible metal wires.

12. A sleeping prevention device in accordance with claim 1, further including a pulley member attached to the driver's seat in a vehicle for changing the direction of said cord member at an angle of at least 90° for more easily accessing said earpiece assembly on the driver's ear.

13. A sleep prevention device in accordance with claim 1, wherein said first contact member further includes two spaced-apart contact members.

14. A sleep prevention devise in accordance with claim 1, wherein said movable cord member having a pair of first contact members thereon, and each of said pair of first contact members are made of metal materials.

15. A sleep prevention device while driving a vehicle, comprising:

a) a stationary bar member having a proximal end and a distal end;

b) a movable cord member having a distal end and a proximal end, said cord member being movable with respect to said stationary bar member and having a first contact member thereon;

c) said bar member having two spaced-apart second contact members thereon for engagement by said first contact member on said cord member;

d) an earpiece assembly including an earpiece housing member having an alarm member therein connected to a speaker member for producing an alarm sound in said earpiece housing member;

e) said distal end of said movable cord member being connected to said earpiece assembly; and f) said first contact member being movable in either a forward direction or a rearward direction as the driver's head moves as the driver starts to doze or fall asleep such that said first contact member engages one of said second contact members in order to activate said alarm member and produce said alarm sound in the driver's ear from said speaker member of said alarm member for awakening the driver from his/her dozing or sleeping state.

16. A sleep prevention device in accordance with claim 15, wherein said proximal end of said stationary bar member includes a bracket holding member having an adjustable bracket member, and having a cord tab member with a cord opening therein.

17. A sleep prevention device in accordance with claim 16, wherein said adjustable bracket member is for detachably holding a coil member thereon.

18. A sleep prevention device in accordance with claim 15, wherein said earpiece housing member includes an earpiece interior compartment, an earpiece opening for receiving said distal end of said movable cord member, and a plurality of speaker openings therein.

19. A sleep prevention device in accordance with claim 17, wherein said second contact members include two sets of spaced-apart metal guide posts, and power connection means connected to each of said two sets of spaced-apart metal guide posts.

20. A sleeping prevention device in accordance with claim 19, wherein each of said two sets of spaced-apart metal guide posts on said bar member are L-shaped and are detachably connected to a central location on said bar member.

21. A sleeping prevention device in accordance with claim 20, wherein said two sets of spaced-apart metal guide posts being attached to said central location on said bar member are used for extending and guiding said movable cord member through said cord tab member of said bracket holding member.

22. A sleep prevention device in accordance with claim 19, wherein said power connection means includes an electrical connector conduit for connection to a power source.

23. A sleep prevention device in accordance with claim 19, further including positive and negative connector tabs connected to each of said two spaced-apart second contact members for connecting to positive and negative connection mounts of said power source for electrical activation of said prevention device to an operational mode.

24. A sleep prevention device in accordance with claim 16, wherein said bracket holding member is made from plastic or metal.

25. A sleeping prevention device in accordance with claim 15, wherein said earpiece housing member includes a holding tab for attachment of said earpiece assembly to an eyeglass frame.

26. A sleeping prevention device in accordance with claim 15, wherein said cord member is made from fiber materials, plastic materials or flexible metal wires.

27. A sleep prevention device in accordance with claim 15, wherein said second contact member is made of metal materials.

28. A sleep prevention device in accordance with claim 15, wherein said movable cord with said distal end and said proximal end having a pair of first contact members thereon, and each of said pair of first contact members are made of metal materials.

29. A sleeping prevention device in accordance with claim 16, wherein said bracket holding member is housed within a headrest of the vehicles' seat.

30. A sleep prevention device in accordance with claim 15, wherein said earpiece housing member includes an alarm member therein connected to said speaker member in said earpiece housing member.

31. A sleep prevention device in accordance with claim 22, wherein said power source is connected to an alarm member.

32. A sleep prevention device while driving a vehicle, comprising:

a) a housing member having an interior compartment;

b) said interior compartment including a first electronic eye for producing a first stationary sensor beam, a second moving electronic eye for producing a second moving sensor beam, a third electronic eye for producing a third stationary sensor beam, a first sensor beam detector and a second sensor beam detector;

c) said second moving sensor beam of said second moving electronic eye being movable in either a forward direction or a rearward direction in order to indicate when a driver's head has moved to a dozing or sleeping state;

d) said interior compartment including an alarm member, a speaker member connected to said alarm member, and a CPU chip; said CPU chip for activation of said alarm member and movement of said second moving sensor beam;

e) said second moving sensor beam electronically activates said first sensor beam detector and said first stationary beam as the driver's head moves in said forward direction in order to activate said alarm member to produce an alarm sound from said alarm member for awakening the dozing or sleeping driver as said alarm sound is generated from said speaker member;

f) said second moving sensor beam electronically activates said second sensor beam detector and said third stationary beam as the driver's head moves in said rearward direction in order to activate said alarm member to produce said alarm sound from said alarm member for awakening the dozing or sleeping driver as said alarm sound is generated from said speaker member; and g) said second moving sensor beam moves back to its original vertical position when the driver's head goes back to a vertical position in order to re-arm said sleep prevention device.

33. A sleeping prevention device in accordance with claim 32, wherein said interior compartment includes a battery compartment for receiving one or more batteries therein as a power source.

34. A sleeping prevention device in accordance with claim 33, wherein said one or more batteries are used for providing power to said alarm member, said first, second and third electronic eyes, said first and second sensor beam detectors and said CPU chip.

35. A sleeping prevention device in accordance with claim 32, wherein said sleep prevention device is directly connected to a power source of the vehicle for providing power to said alarm member, said first, second and third electronic eyes, said first and second sensor beam detectors and said CPU chip.

36. A sleeping prevention device in accordance with claim 34, wherein said one or more batteries are electrically connected to an on-off power switch.

37. A sleeping prevention device in accordance with claim 36, wherein said on-off power switch is positioned on a wall of said housing member.

38. A sleeping prevention device in accordance with claim 32, wherein said housing member includes a first wall having a plurality of speaker openings therein for receiving said alarm sounds of said alarm member from said speaker member.

39. A sleeping prevention device in accordance with claim 38, wherein said first wall includes a first wall opening for receiving said first electronic eye thereon, a second wall opening for receiving said second moving electronic eye therein and a third wall opening for receiving said third electronic eye therein.

40. A sleep prevention device in accordance with claim 32, wherein said first, second and third sensor beams are UV sensor beams or IR sensor beams being invisible.

41. A sleeping prevention device in accordance with claim 32, wherein said first and second sensor beam detectors are for activating said alarm member upon contact of said second moving sensor beam of said second moving electronic eye.

* * * * *